US008967364B2

(12) United States Patent
Kleine-Brüggeney et al.

(10) Patent No.: US 8,967,364 B2
(45) Date of Patent: Mar. 3, 2015

(54) SELF-REGULATING HEATING CABLE FOR A PASSENGER CONVEYOR COMPONENT

(71) Applicants: Hans Kleine-Brüggeney, Hattingen (DE); Heinrich Zeiger, Muenster (DE)

(72) Inventors: Hans Kleine-Brüggeney, Hattingen (DE); Heinrich Zeiger, Muenster (DE)

(73) Assignee: Kone Corporation, Helsinki (FI)

( * ) Notice: Subject to any disclaimer, the term of this patent is extended or adjusted under 35 U.S.C. 154(b) by 0 days.

(21) Appl. No.: 14/151,283

(22) Filed: Jan. 9, 2014

(65) Prior Publication Data

US 2014/0124329 A1 May 8, 2014

Related U.S. Application Data

(63) Continuation of application No. PCT/EP2011/064469, filed on Aug. 23, 2011.

(51) Int. Cl.

| | |
|---|---|
| ***B66B 31/00*** | (2006.01) |
| ***B66B 23/12*** | (2006.01) |
| ***B66B 23/24*** | (2006.01) |
| ***B66B 31/02*** | (2006.01) |

(52) U.S. Cl.

CPC ..... *B66B 23/12* (2013.01); *B66B 23/24* (2013.01); *B66B 31/00* (2013.01); *B66B 31/02* (2013.01)

USPC ..... 198/333; 198/322; 198/326; 198/335; 198/337

(58) Field of Classification Search

CPC ..... B66B 23/00; B66B 25/00; B66B 27/00; B66B 29/00; B66B 31/00

USPC ..... 198/321, 322, 323, 326, 330, 333, 952

See application file for complete search history.

(56) References Cited

U.S. PATENT DOCUMENTS

| | | | | |
|---|---|---|---|---|
| 6,382,389 | B1 * | 5/2002 | Mehlert et al. | 198/335 |
| 6,994,204 | B2 * | 2/2006 | Buescher et al. | 198/335 |
| 7,201,269 | B2 * | 4/2007 | Buscher et al. | 198/335 |
| 7,389,866 | B2 * | 6/2008 | Kawasaki | 198/335 |

FOREIGN PATENT DOCUMENTS

| | | | |
|---|---|---|---|
| DE | 1266466 | B | * 10/1973 |
| GB | 2390004 | A | 12/2003 |
| JP | H10-182044 | A | 7/1998 |
| JP | 11079648 | A | * 3/1999 |
| JP | 2001-302161 | A | 10/2001 |
| JP | 2001302161 | A | * 10/2001 |
| JP | 2010-195569 | A | 9/2010 |

OTHER PUBLICATIONS

International Search Report for PCT/EP20111064469 dated Apr. 23, 2012.

Written Opinion for PCT/EP20111064469 dated Apr. 23, 2012.

* cited by examiner

*Primary Examiner* — Leslie A Nicholson, III

(74) *Attorney, Agent, or Firm* — Harness, Dickey & Pierce, P.L.C.

(57) ABSTRACT

The invention relates to a passenger conveyor comprising steps/pallets which are mounted to an endless drive member running between an upper conveying path and a lower return path, characterized in that at least one heating element is provided in the step/pallet, which heating element is connected to a power source. This solution prevents the building of ice surfaces on the steps/pallets of outdoor passenger conveyors.

20 Claims, 4 Drawing Sheets

SELF-REGULATING HEATING CABLE FOR A PASSENGER CONVEYOR COMPONENT

Figure 1:
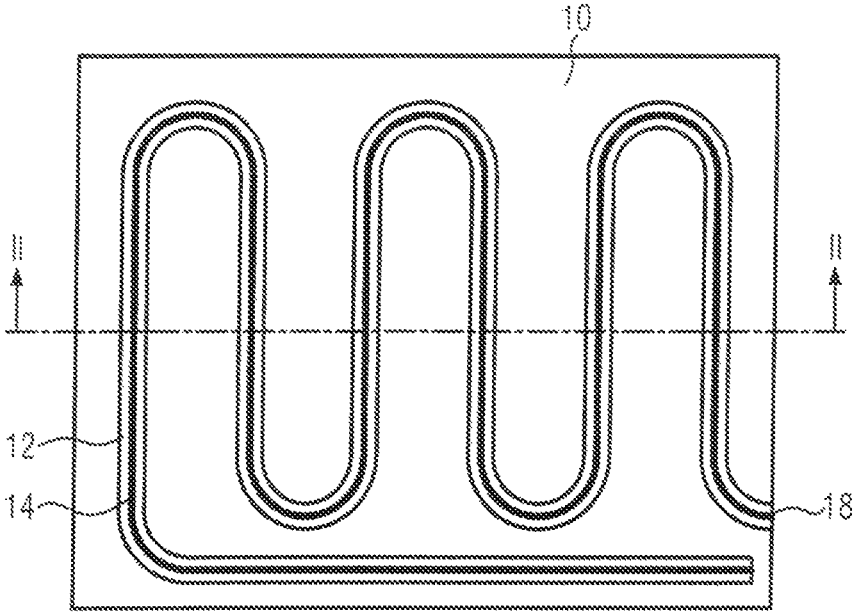

This application is a continuation of PCT International Application No. PCT/EP2011/064469 which has an International filing date of Aug. 23, 2011, the entire contents of which are incorporated herein by reference.

The present invention refers to a passenger conveyor as e.g. an escalator, auto walk or auto ramp, comprising steps or pallets which are mounted to an endless drive member running between an upper conveying path and a lower return path. Usually, these passenger conveyors comprise on at least one side lateral of the conveying path a balustrade carrying a handrail belt driven by a handrail belt drive. These basic types of passenger conveyors to which the present invention is directed are sometimes arranged at least partially outdoors, e.g. in connection with public traffic applications, and are thus subject to the prevailing weather conditions. Particularly, in winter time sometimes ice may adhere to the surface of the steps or pallets, particularly during standstill periods of the conveyor, e.g. during the night or at low traffic conditions if an access monitoring is used to start the conveyor. The restart after these standstill periods may provide problems, as an ice layer may have built on the step/pallet surface causing problems when hitting the comb plates. Furthermore, also a thin ice layer on the step or pallet surface may lead to dangerous use conditions for the passengers, who easily tend to slip and fall on the slippery ice covered steps or pallets. Furthermore, ice or snow on the handrail belt may cause problems in the guiding and drive sections of the conveyor.

Efforts have been made to prevent the formation of ice on escalator steps. Thus, the JP 10182044 uses a heated comb plate to remove ice from the steps pallets. Another solution is shown in the U.S. Pat. No. 7,201,269 which provides heating elements pivotably mounted to the conveyor frame to blow hot air on the steps pallets. This latter solution seems to be quite energy consuming as only a part of the heating energy is transferred to the steps pallets.

It is object of the present invention to overcome at least a part of the above-mentioned problems and to create a conveyor which effectively reduces the safety of outdoor conveyors during winter time.

According to the invention the above-mentioned problems are solved with a passenger conveyor according to one or more example embodiments.

The passenger conveyor of the invention has a conveyor structure with a conveying member. The conveying member comprises steps/pallets which are connected to an endless drive member running between an upper conveying path and a lower return path. These kinds of passenger conveyors are known e.g. as autowalks or escalators. According to the invention each step/pallet comprises a heating element connected to a power source.

This inventive solution has the advantage that the heat is generated at the location where it is needed to prevent the building of ice layers, i.e. in the pallets, steps or their tread plates. This leads to an economic use of heating energy. The heating energy may be controlled via an electronic control having ambient temperature measuring abilities and/or via PTC heating elements which have a kind of self adjusting ability to adapt their heating power according to ambient temperatures. The electronic control may be part of the conveyor control.

Heating elements are per se known in the art, as e.g. heating wires, ceramic heating elements, resistance heating elements etc. At least, one of these kinds of heating elements is connected to each step or pallet of the passenger conveyor and/or to the handrail. The heating element is connected to an internal or external power source of the conveyor. The power source may be either the mains to which the conveyor is connected or a particular power output in the electric/electronic control of the passenger conveyor. Of course, it is also possible to provide the power source in the passenger conveyor itself, e.g. as separate generators, as it will be carried out in more detail later on.

Preferably the heating element is connected via a heat conducting embedding matrix to the corresponding conveyor components as e.g. steps, pallets and/or handrails. A heat conducting matrix may be a glue or polymer with good heat conducting properties, e.g. comprising metal or other heat conducting fillers. This enables a good heat transfer from the heating element to the corresponding conveyor component.

Preferably, the heating element is a PTC heating element in which generated heating power depends on the temperature of the heating element which is widely affected by the environment. Such self-adjusting heating members are known in the art. They usually comprise conducting elements as wires or plates which are connected via a polymer matrix with a positive temperature coefficient (PTC). A usual distribution type of such kind of heating element is a heating cable or heating belt provided with two wires encapsulated by a PTC polymer matrix. Such a product is for example the self-regulating heating cable RSX.TM. 15-2 of THERMON. The advantage of this kind of PTC heating element is that the heating energy is self-adjusting corresponding to the ambient temperatures. Thus, if the temperature is below 0 degree Celsius the heating element can be adjusted to increase the heating power whereby the heating power tends to become zero if the temperature rises above 0 to 5 degrees Celsius. With such a self-adjusting PTC heating element no external control is necessary for the heating element to be switched on and off depending on the prevailing weather conditions to effectively prevent the ice formation on the steps/pallets.

The above kind of PTC cable enables continuous regulation/change of power supplied, which means that it can, without unreasonable effort, be configured to be more energy-efficient than in traditional solutions where the heating resistance is substantially constant.

As the heating solution according to the invention is substantially simple, eg. does not require many separate control system components, system feedback signals etc., it can also be easily installed during modernization of an old conveyor system.

Another well adapted PTC element is of the type Minika® of Ziehl Industrie-elektronik GmbH & Co KG.

In a preferred embodiment of the invention at least one electrically conductive pallet contact track is connected to the endless drive member. The heating elements in the steps or pallets are connected to this pallet contact track. The power connection to the pallet contact track may occur via at least one electric sliding contact or contact wheel mounted to the conveyor structure. Via this arrangement a comparably reliable and easy transfer of electric power from the power source to the steps or pallets is possible which on one hand does not affect the visual appearance of the passenger conveyor and on the other hand does not interfere essentially with other mechanical components in the conveyor, particularly during installation and maintenance.

The pallet contact track is preferably backed up in the region of the sliding contacts or contact wheels by back wheels or back surfaces mounted to the conveyor structure at the opposite side of the sliding contacts or contact wheels. These back wheels or back surfaces allow the appliance of a certain pressure of the sliding contacts or contact wheels to the corresponding contact track. Via this measure the reliability of the electric connection between the sliding contact/contact wheel and the contact track may be essentially improved.

For the heating of the steps or pallets an advantageous embodiment of the invention is characterized in that each step or pallet of the passenger conveyor comprises rollers for supporting the corresponding step/pallet on guiding tracks of the passenger conveyor. At least one of these rollers may comprise an electric generator providing the necessary power source for the heating element of at least the corresponding step/pallet. The advantage of this solution is that no additional contact means have to be provided in the passenger conveyor to transfer the power from the conveyor structure to the moving heating elements. This simplifies the provision of the heating power for the individual steps, essentially. Thereby, one generator may be provided for one or several steps, e.g. for two or three or four adjacent steps or pallets. This embodiment is preferably adapted for the use in connection with a self-adjusting heating element because in this case no further control connectors have to be provided for the regulation or activation of the heating elements.

In further preferred embodiment the steps and pallets of the passenger conveyor comprise wheels which run on running tracks of the conveyor structure. In this case preferably at least one wheel is electrically connected to the heating element of the step or pallet. This wheel is electrically conductive and runs in a running track of the passenger conveyor having a fixed contact track which is isolated against ground and connected to the power source. With the running wheels running in said running track the heating element is provided with electric power via the fixed contact track and the conductive wheel. Also this solution provides a very simple and reliable arrangement for the transfer of electric power to the corresponding heating element(s) of the tracks or pallets. Of course, two electrically conductive wheels of each step or pallet may be connected to the two connectors of the corresponding heating element. In this case e.g. one wheel may run in a running track provided with the fixed contact track whereas the other wheel is running in a running track connected to ground. In this embodiment self-adjusting heating elements in a PTC technique as described above, may be used, in which case no control of the heating elements has to be performed. On the other the heating elements may be connected to a power output of the conveyor control. Thus, it is possible to provide a circuit in the control of the passenger conveyor measuring the environment temperature or the temperature of the steps or handrail and to control the power to the heating elements dependent on the ambient temperature.

Of course, it is possible to provide two fixed contact tracks which are isolated against ground in which case the power transmission to the heating elements does not require a ground contact of the steps or pallets.

Preferably, a passenger conveyor comprises steps or pallets having a step/pallet body and a tread plate which is generally detachably mounted thereto. The heating element is then preferably provided in the tread plate. This preferred embodiment has the advantage that the heating elements may be easily replaced by simply dismounting the tread plate of the corresponding step/pallet without dismounting the complete conveyor member. Preferably the connection of the heating element in the tread plate to an electric contact provided at the step/pallet body is performed via an electric plug and socket connection of which a first member is provided in the tread plate and a second member is provided at the step/pallet body such that connection is automatically performed when the tread plate is mounted to the step/pallet body. In this case no difficult wiring or connection work has to be performed when the tread plate with the heating element is changed.

Further it is possible to switch the heating element on/off via the use of a PTS sensor element which gives precise information about the ambient temperature via its resistance. The PTC sensor may thus be used to control a relay for activating/deactivating the heating element.

Additionally or alternatively, the passenger conveyor comprises a conveyor structure having an endless conveying member running on an upper conveying path and a lower return path and at least one balustrade arranged laterally of the conveying path, which balustrade carries a handrail belt driven by a handrail belt drive. According to this aspect of the invention the handrail belt comprises at least one PTC heating element embedded therein, which heating element is connected to a power source via at least one electric conductor, e.g. metal conductor, extending in longitudinal direction of the handrail belt, which electric conductor is arranged on surface of the handrail belt facing the balustrade, which electric conductor is contacted by contactors being fixed to the conveyor structure and connected to the power source. The PTC heating cable or layer is embedded in the handrail and is connected to first and second longitudinal metal conductors, with the PCT resistor material of the heating element electrically connected between them. When a voltage is provided between said first and second metal conductors, current flows from the first metal conductor to the second metal conductor through the PCT resistor material. When current flows in a PTC material it heats up, after which the current in the PTC material goes down providing self-regulation effect; this is due to the fact that PTC material resistance increases when temperature increases. Now, if a part x of the handrail/balustrade is in a lower temperature zone, for example located outdoors, the PTC material temperature it that part x of the cable goes down and accordingly the resistance of the PTC material goes down with the result that the current flow in that part x of the PCT material goes up. As the generated heating power P is related to 2nd power of current I: P=R*I^2, this means that more heating power is provided in that low temperature part x of the cable, which therefore heats more efficiently.

Thus, the inventive solution has the advantage that the heating of the handrail is self-adjusting to the surrounding ambient temperatures without the necessity of an additional control device. Further, as the PTC heating element(s) is/are arranged in the handrail belt the heating is effected in an advantageous effective manner without essential losses to the environment as in the case of fan heaters.

In an advantageous embodiment of the invention he PTC heating element may be either a flexible heating element extending along the length of the handrail or a succession of numerous small heating elements fixed to the inner side or the interior of the handrail belt. With such kind of passenger conveyor arrangement the handrail belt may be heated such a way as to prevent the building of an ice layer on the handrail belt or avoiding that the handrail belt gets so cold that the gripping of the handrail belt by passengers becomes uncomfortable. This handrail heating element may be used alone or in connection with the above mentioned pallet/step heating arrangement in the conveyor.

Adapted self-adjusting PTC heating members usable for the handrail are per se known in the art and described above in connection with the PTC step/pallet heating element.

In a preferred embodiment of this invention the passenger conveyor has a handrail belt, which carries on its inner side facing the belt carrier on the balustrade at least one electrically conductive handrail conductor extending in longitudinal direction of the handrail belt. This conductor of the handrail belt may be contacted by at least one sliding contact or contact wheel mounted to a fixed structure of the passenger conveyor to transfer the electric power from the passenger conveyor to the heating element in the moving handrail belt. Such a kind of electrical contact has the advantage that it is comparably reliable and does not affect the outer appearance of the handrail belt. Of course, each PTC heating element in the handrail belt is electrically connected to said handrail conductor.

If the balustrade is made of metal connected to ground, a second contact of the heating element may be achieved by a contact surface of the handrail belt sliding along a metal carrier of the balustrade contacted to ground. Otherwise two or more handrail contact tracks may be provided parallel to each other on the handrail belt. In this case both electric connections to the heating element can be provided via handrail contact tracks.

The advantage of the PTC handrail heating elements is that the heating is performed only under corresponding weather conditions in a very effective manner. Further the heating elements are self-adjusting such that the heating power goes to zero if the temperature exceeds e.g. 10 degrees Celsius.

Advantageously the PTC heating element in the handrail belt may consist of several parallel longitudinal heating elements extending in longitudinal direction of the handrail belt. Preferably these separate elements may be switched on/off via separate handrail contact tracks to enable a power adjustment of the heating elements beside their self adjusting heating ability caused by the PTC heating characteristics. The PTC elements may e.g. be shaped as layers or cables.

Finally, the invention also relates to the use of a PTC (positive temperature coefficient) heating element, particularly according to any of the previous specifications, in a comb plate of a passenger conveyor. It is well known in the art to provide comb plates at the inlet and outlet ends of a passenger conveyor, as e.g. an escalator or an autowalk, which combs with the corrugated surface of the pallets or steps of the passenger conveyor. From the above mentioned JP publication it is known to provide a heating element in the comb plate to remove ice form the step/pallet surface. The problem of this arrangement is that the comb plate heater has to be controlled manually by the operating staff or via a separate control module which gets the ambient temperature as parameter for the heating power supply. This adds complex control modules to the necessary central conveyor control. With the use of a heating element, particularly a heating cable with PTC resistance characteristics the heating element self adjusts according to the environmental temperature conditions.

It shall be understood by the skilled person that the above mentioned preferred embodiments may be combined with each other unless technical components of the different embodiments interfere with each other.

The invention is now described schematically by the aid of the enclosed drawings.

Figure 2:
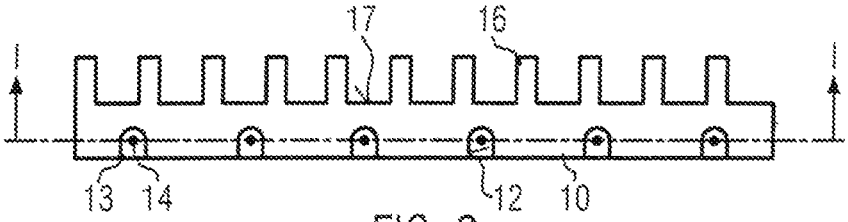
Figure 3:
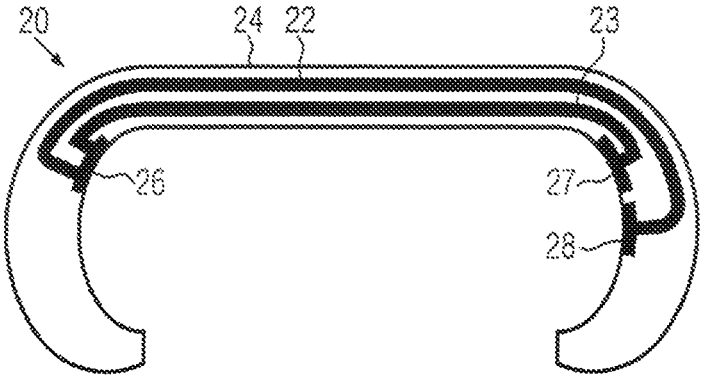
Figure 4:
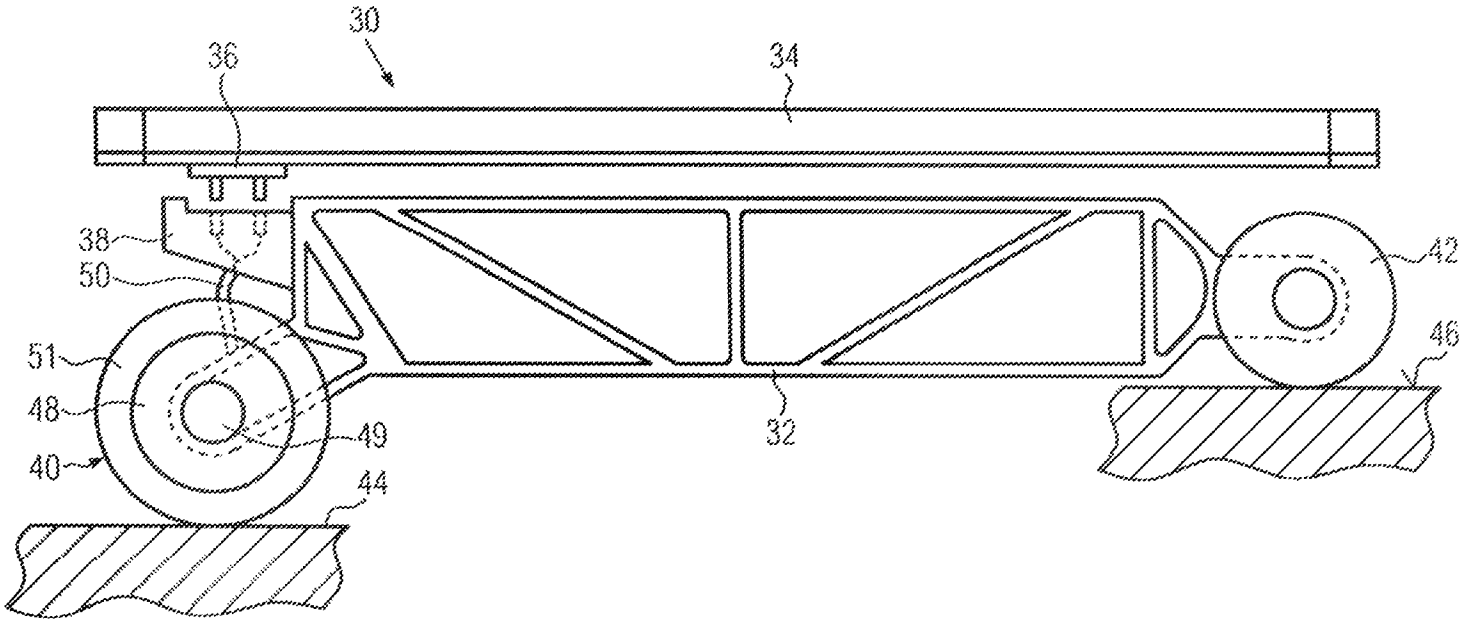
Figure 5:
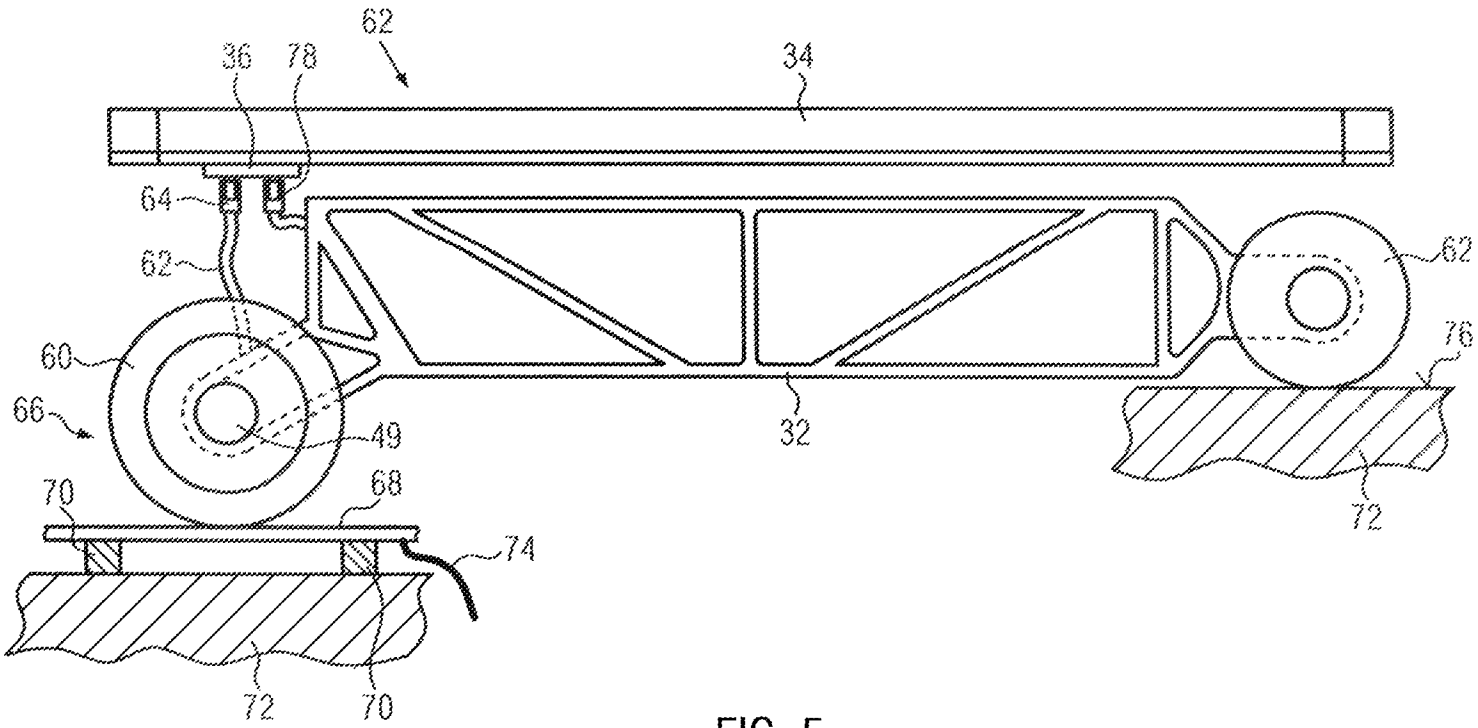
Figure 6:
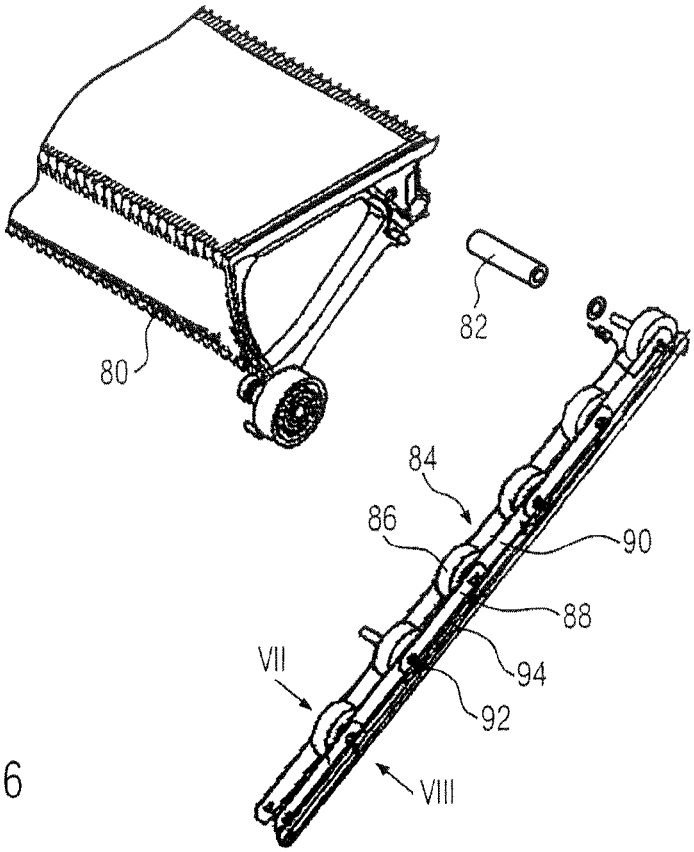
Figure 7:
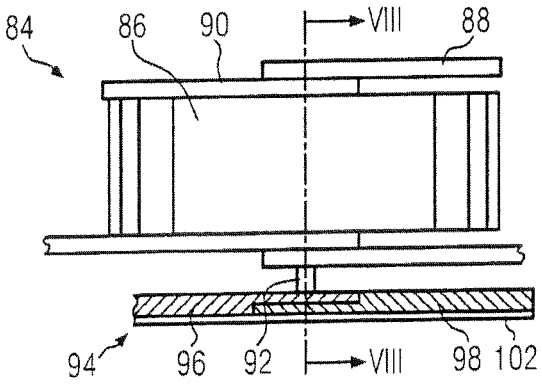
Figure 8:
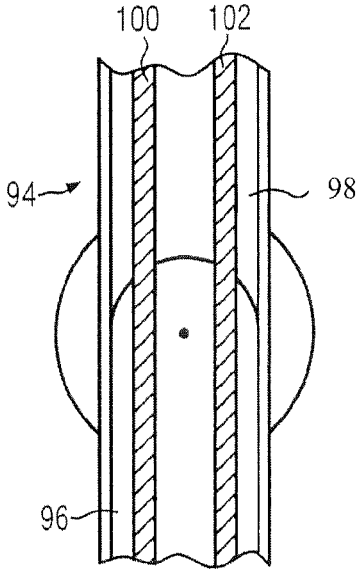

FIG. 1 shows a horizontal sectional view of a tread plate,

FIG. 2 shows a vertical section through the tread plate of FIG. 1 according the line II-II, FIG. 3 shows a vertical section through a hand rail belt, FIG. 4 shows a side view of a pallet of a passenger conveyor comprising a detachable tread plate with a heating element, FIG. 5 shows a side view of a further embodiment of a pallet with a detachable tread plate, FIG. 6 shows a perspective view of a part of a step together with a corresponding driving member provided with a contact track, FIG. 7 shows the detail according to view VII from FIG. 6, and FIG. 8 shows a detail according to the view VIII from FIGS. 6 and 7.

FIGS. 1 and 2 show a tread plate 10 of the pallet or step of a passenger conveyor comprising a channel 12 for encapsulating a self-adjusting PTC heating cable 14. The tread plate 10 comprises on its upper side a corrugation 16 forming the surface of the step or pallet. This corrugation improves the safety for the use by the passengers. The self-adjusting PTC heating cable 14 is embedded in the channel 12 with a heat conducting polymer matrix 13 which may consist of a kind of adhesive and a filler with good heat conducting properties, e.g. metal powder. The tread plate is preferably made of aluminum but may also be formed from other materials, e.g. stainless steel, steel or plastics. The self-regulating PTC heating cable 14 is electrically connected to a contactor 18 which automatically connects to corresponding connectors of a step or pallet body when the tread plate 10 is mounted on the step or pallet body. The meander like arrangement of the heating cable 14 in the tread plate leads to a homogenous heat distribution in the tread plate 10 and effectively prevents the building of an ice layer on the tread plate 10, particularly in recesses 17 of the corrugations 16. The PTC elements are advantageously adjusted that the heating power becomes zero if the ambient temperature exceeds 0 to 5 degrees Celsius. With this adjustment the building of an ice layer may be effectively prevented.

FIG. 3 shows a handrail belt 20 in a vertical sectional view. The hand rail belt 20 has a body 22 comprising a polymer or rubber matrix. In this handrail belt a first PTC heating layer 23 is embedded, which layer is connected between a first metal conductor 26 and a second metal conductor 27 located on the side of the handrail belt facing the balustrade. Furthermore, a second PTC heating layer is embedded in the handrail belt parallel to the first layer and connected between the first metal conductor 26 and a third metal conductor 28. The metal conductors 26, 27 and 28 extend along the length of the endless handrail belt 20 and are to be connected by sliding contacts or contact wheels mounted in connection with the structure of the passenger conveyor (not shown). By this arrangement the self-adjusting heating layers 23 and 24 can be provided independently with the necessary power for the heating of the handrail under corresponding environmental conditions. The provision of two layers which can be switched on independently allows the adaption of the heating power to the environmental circumstances. Accordingly the second PTC layer may be switched on only in case of very cold weather, e.g. below minus 5 degrees Celsius. Instead of heating layers also heating cables may be used, e.g. as known from Thermon RSX™ 15-2. The number of parallel heating elements may very e.g. between 2 and 10. In most cases the provision of a single heating element in the handrail will be sufficient. The self-adjusting properties of the heating cable provide for a heating only or particularly in case of the corresponding prevailing weather conditions, particularly temperatures below 10 degrees Celsius. The conductors may be made from another electrically conductive material except metal. Further, the location of the conductors may be different from the arrangement shown in the figure.

FIG. 4 shows a pallet 30 of an auto walk or auto ramp. The pallet 30 is connected together with other pallets to an endless chain or belt (not shown) running between an upper conveying path and a lower return path.

The pallet 30 comprises a pallet body 32 and a tread plate 34 which can be fixed on the pallet body 32. The tread plate 34 has on its bottom side a first part 36 of a plug and socket connector. The second part 38 of the plug and socket connector is mounted to the pallet body 32. The first and second part 36, 38 of the plug connector are figured to automatically connect when the tread plate 34 is mounted on the pallet body 32. The pallet body is connected with two parallel front wheels 40 and two parallel back wheels 42. The front wheels 40 run on first running tracks 44 of the passenger conveyor whereas the back wheels run on second running tracks 46. At least one of the front wheels 40 comprises a generator 48 which is connected via an electric cable 50 to the second part 38 of the plug connector. When the passenger conveyor is moving the first wheels 40 run on the first running track 44, whereby the generator 48 is provided between the fixed shaft 49 of the first wheel 40 and the tire 51 thereof. The heating element may be arranged in the tread plate as it is shown for example in FIGS. 1 and 2. By this arrangement the generator 48 provides sufficient energy for at least this pallet 30. Either for each step/pallet a generator is provided or the generator may be configured to provide the power supply of the adjacent step/pallets of the passenger conveyor, in which case less generators than steps/pallets are required.

FIG. 5 shows another embodiment of an arrangement with a heated pallet. Identical or similar parts to FIG. 4 are designated with the same reference numerals. Also in this case the tread plate 34 is detachably mounted on the pallet body 32. Also in this embodiment the pallet body 32 may comprise a second part 38 of a plug connector as it is shown in FIG. 4. The first wheel 60 of this pallet 62 is electrically conductive from the shaft to the circumference thereof. The wheel 60 is electrically connected via an electrical cable 62 to a first socket connector 64 which is connected with one contactor of the first part 36 of the plug connector of the tread plate 34.

The first wheel 60 is electrically isolated against the pallet body 32 and runs on a first running track 66 which consists of an electrically conductive contact track 68 which is electrically isolated against ground 72 via isolators 70. The contact track 68 is connected via a cable 74 with an external or internal power source of the passenger conveyor.

In contrast thereto the second wheel 62 runs on a second running track 76 which is electrically conducted to ground. The second wheel 62 is also electrically connected to the metal body of the pallet body 32 and a second contactor 78 is electrically connected to the pallet body 32 which is connected with a second contactor of the first part 36 of the electric plug and socket connection of the tread plate 34. In this embodiment the front and back wheels 60, 62 are forming electric contact wheels to provide the electric power for the heating elements. In contrast thereto the conductive wheels may be formed by the two front or back wheels only. The heating element 14 may be arranged in the tread plate 34 as it is shown in FIGS. 1 and 2. The heating element in the tread plate 34 may be a simple heating cable or a self-adjusting PTC heating cable which automatically adjusts the heating power to the prevailing environmental temperature conditions.

FIG. 6 shows a step 80 of an escalator which is connected via a pin 82 to endless drive member 84 of the escalator. The endless drive member 84 is a driving chain comprising wheels 86 connected via first and a second chain links 88, 90. The wheels are connected to the first and second chain links 88, 90 via chain axes 92.

The driving chain 84 is provided with a pallet contact track 94 which is more clearly shown in FIGS. 7 and 8. The pallet contact track 94 is connected to the driving chain 84 via the axes 92 of the driving chain 84. The pallet contact track 94 comprises isolating link members 96, 98 which are pivotally connected to the shaft 92 of the driving chain 84. On the surface of the isolating link members 96, 98 two electrically conductive tracks 100, 102 are provided. The heating elements of all steps 80 of the escalator are connected to these conductive tracks 100, 102. The conductive tracks 100, 102 are to be contacted by sliding contacts or contact wheels (not shown) mounted in connection with the escalator structure. This arrangement allows a quite compact solution for the connection of the heating elements to the power source in all steps.

It shall be understood by the skilled person that the invention is not limited to the embodiments described above. Rather embodiments of the invention may vary within the scope of the protection of the claims. Furthermore, it shall be clear for the skilled person that single features of the different embodiments may be combined with other embodiments as long as this is technically reasonable.

The invention claimed is:

1. A passenger conveyor comprising:

steps/pallets connected to an endless drive member running between an upper conveying path and a lower return path, each step/pallet including a heating element connected to a power source.

2. The passenger conveyor according to claim 1, wherein the heating element is configured to connect to a corresponding step/pallet via a heat conducting matrix.

3. The passenger conveyor according to claim 1, wherein the heating element is a Positive Temperature Coefficient (PTC) heating element, the PTC heating element configured to self-adjust a heating power thereof depending on an ambient temperature.

4. The passenger conveyor according to claim 3, wherein the PTC heating element is a heating cable, the heating cable including at least two parallel wires encased by a PTC polymer matrix.

5. The passenger conveyor according to claim 1, wherein the heating element is in the steps/pallet in a meander-like configuration.

6. The passenger conveyor according to claim 1, further comprising:

at least one electrically conductive pallet contact track connected to the endless drive member, the heating elements in the steps/pallets are connected, and which pallet contact track is contacted by at least one sliding contact or contact wheel mounted to the conveyor structure.

7. The passenger conveyor according to claim 1, wherein the steps/pallets comprise:

wheels running in running tracks of an escalator/autowalk, the wheels including at least one electrically conductive first wheel configured to electrically connect to the heating element of the step/pallet, and the running tracks including a fixed contact track, the fixed conact track configured to connect to the power souce and be isolated against ground.

8. The passenger conveyor according to claim 7, wherein two wheels of the step/pallet are running in two different running tracks, a first one of the two different running tracks being the fixed contact track and a second one of the two different running tracks being electrically connected to ground.

9. The passenger conveyor according to claim 1, wherein each step/pallet comprises:

rollers configured to drive on guiding tracks, at least one step/pallet having a corresponding roller configured to electrically connect to an electric generator, the electric generator configured to provide the power source for the heating elements.

10. The passenger conveyor according to claim 9, wherein each step/pallet includes a separate generator configured as the power source for the heating element therein.

11. The passenger conveyor according to claim 1, wherein each step/pallet comprises:

a step/pallet body and a tread plate mounted thereto, wherein the heating element is in the tread plate.

12. The passenger conveyor according to claim 11, wherein the heating element is connected to a first one of an electrical plug and an electrical socket provided at the tread plate, the first one of the electrical plug and electrical socket configured to automatically connect with a second one of the electrical plug and electrical socket provided at the step/pallet body when the tread plate is mounted to the step/pallet body.

13. The passenger conveyor according to claim 1, further comprising:

a switching device configured to switch the heating element, the switching device including a PTC sensor element.

14. A passenger conveyor comprising:

a conveyor structure having an endless conveying member running on a conveying path, the conveying path including an upper conveying path and a lower return path; and at least one balustrade arranged laterally of the conveying path, the balustrade configured to carry a handrail belt driven by a handrail belt drive, the handrail belt including at least one Positive Temperature Coefficient (PTC) heating element embedded therein the PTC heating element configured to electrically connect to a power source via at least two electric conductors extending in longitudinal direction of the handrail belt, the electric conductors configured to contact contactors that are fixed to the conveyor structure and connected to the power source.

15. The passenger conveyor according to claim 14, wherein the electric conductors are on surface of the handrail belt facing the balustrade.

16. The passenger conveyor according to claim 14, wherein the contactors are sliding contactors or contact wheels.

17. A movable element of a passenger conveyor, the movable element comprising:

a Positive Temperature Coefficient (PTC) heating element, the PTC heating element configured to self-adjust a heating power thereof depending on an ambient temperature.

18. The movable element of claim 17, wherein the movable element is a comb plate.

19. The moveable element of claim 17, wherein the movable element is one or more of a step/pallet and a handrail belt.

20. The moveable element of claim 17, wherein the PTC heating element is configured to connect to the movable element via a heat conducting matrix.

* * * * *